US009228798B1

(12) United States Patent
Viola

(10) Patent No.: US 9,228,798 B1
(45) Date of Patent: Jan. 5, 2016

(54) RIFLE FORE GRIP WITH MOUNT FOR QUICK RELEASE OF ACCESSORIES

(71) Applicant: Tactical Underground, Inc., Arkansas City, KS (US)

(72) Inventor: Alex Austin Viola, Arkansas City, KS (US)

(73) Assignee: Tactical Underground, Inc., Arkansas City, KS (US)

( * ) Notice: Subject to any disclaimer, the term of this patent is extended or adjusted under 35 U.S.C. 154(b) by 0 days.

(21) Appl. No.: 14/547,593

(22) Filed: Nov. 19, 2014

Related U.S. Application Data

(60) Provisional application No. 61/910,638, filed on Dec. 2, 2013.

(51) Int. Cl.
*F41C 23/16* (2006.01)
*F41B 15/08* (2006.01)
*F41C 23/12* (2006.01)

(52) U.S. Cl.
CPC ..... *F41C 23/16* (2013.01); *F41B 15/08* (2013.01); *F41C 23/12* (2013.01)

(58) Field of Classification Search
CPC ..... F41C 23/16; F41C 23/06; F41C 23/12; F41B 15/08
USPC ..... 42/72, 71.01
See application file for complete search history.

(56) References Cited

U.S. PATENT DOCUMENTS

| | | | | |
|---|---|---|---|---|
| 2,386,802 | A | 10/1945 | Johnson | |
| 2,805,507 | A | 9/1957 | Buquor | |
| 6,655,069 | B2 | 12/2003 | Kim | |
| 6,792,711 | B2 | 9/2004 | Battaglia | |
| 6,981,344 | B2 * | 1/2006 | Cahill et al. | 42/71.01 |
| 7,243,454 | B1 | 7/2007 | Cahill | |
| 7,827,726 | B2 | 11/2010 | Stokes | |
| 8,109,032 | B2 | 2/2012 | Faifer | |
| 8,215,047 | B2 | 7/2012 | Ash, Jr. et al. | |
| 8,245,428 | B2 | 8/2012 | Griffin | |
| 8,984,789 | B2 | 3/2015 | Adcock, Jr. | |
| D728,725 | S | 5/2015 | Anderson et al. | |
| 2008/0168696 | A1 | 7/2008 | Orne et al. | |
| 2009/0178325 | A1 | 7/2009 | Veilleux | |
| 2009/0193702 | A1 | 8/2009 | Lin | |
| 2010/0229448 | A1 | 9/2010 | Houde-Walter et al. | |
| 2010/0229450 | A1 | 9/2010 | Becker et al. | |
| 2011/0032694 | A1 | 2/2011 | Swan et al. | |
| 2011/0047850 | A1 | 3/2011 | Rievley et al. | |
| 2011/0107643 | A1 | 5/2011 | Fitzpatrick et al. | |
| 2012/0055061 | A1 | 3/2012 | Hartley et al. | |
| 2013/0000174 | A1 * | 1/2013 | Troy et al. | 42/72 |
| 2014/0182182 | A1 | 7/2014 | Adcock, Jr. | |
| 2014/0215884 | A1 | 8/2014 | Adcock, Jr. | |
| 2014/0230303 | A1 | 8/2014 | Rice | |
| 2014/0338245 | A1 | 11/2014 | Lanasa et al. | |
| 2015/0121737 | A1 * | 5/2015 | Anderson et al. | 42/72 |

FOREIGN PATENT DOCUMENTS

WO WO 2005/047801 * 5/2005

* cited by examiner

*Primary Examiner* — Stephen M Johnson
(74) *Attorney, Agent, or Firm* — Mary M. Lee

(57) ABSTRACT

A rifle fore grip to quickly mount and dismount different attachments includes a body member operably connected to the rifle, the body member having a cavity to receive the attachment, and a latch mechanism operably connected to the body member. The latch mechanism releasably secures the attachment received through the cavity of the body member in a first locked position and releases the attachment in a second unlocked position.

19 Claims, 2 Drawing Sheets

RIFLE FORE GRIP WITH MOUNT FOR QUICK RELEASE OF ACCESSORIES

CROSS-REFERENCE TO RELATED APPLICATIONS

This application claims the benefit of U.S. provisional application No. 61/910,638 entitled "Rifle Fore Grip with Mount for Quick Release of Attachments," filed Dec. 2, 2013, the contents of which are incorporated herein by reference.

FIELD OF THE INVENTION

The present invention relates to firearms generally and, more particularly but without limitation, to devices for attaching accessories to rifles.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate a preferred embodiment of the invention and are not to be construed as limiting the scope of the invention.

BACKGROUND OF THE INVENTION

Gun enthusiasts and combat specialists often carry a variety of attachments or accessories for use with their rifles. These attachments may include bipods, lights, red dot lasers, "brass knuckles," knives, and the like. As a result, these users seek ways to conveniently store and retrieve these attachments when operating their rifles. The present invention provides a rifle fore grip with a built-in locking mechanism that effectively secures and releases different attachments. The fore grip attaches directly to the rifle; no additional mounting or housing is necessary. This minimizes the total weight of the rifle when the fore grip and any attachments are secured to it. This reduces the tendency of the attachments to negatively affect the user's overall performance and shooting accuracy.

DETAILED DESCRIPTION OF THE PREFERRED EMBODIMENT(S)

The present invention provides a rifle fore grip that permits the user to quickly mount and dismount different attachments. The fore grip comprises a body member operably connected to the rifle. The body member comprises a cavity configured to receive the attachment and a locking mechanism operably connected to the body member. The locking mechanism secures the attachment received through the cavity of the body member in a first locked position and releases the attachment in a second unlocked position.

Figure 1:
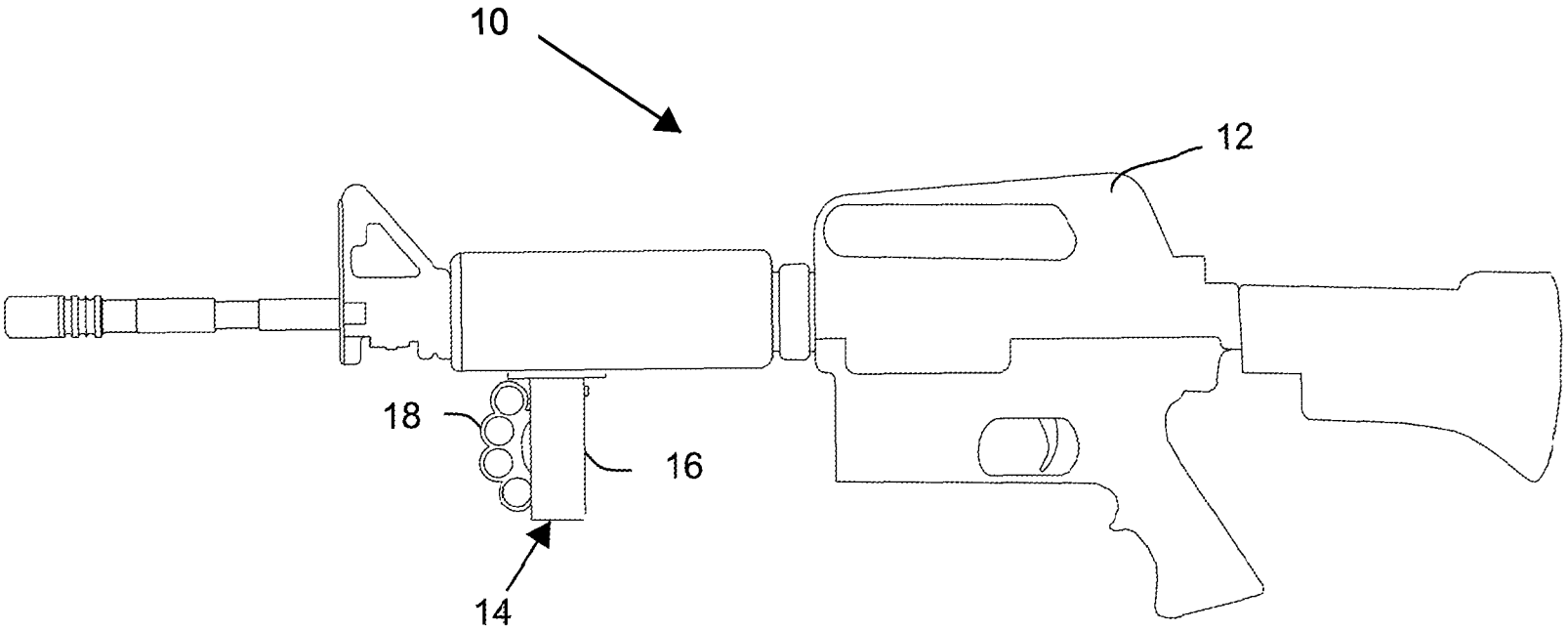
FIG. 1 depicts a side elevation view of the fore grip in use with a rifle in accordance with an embodiment of the invention.

Shown in FIG. 1 is a rifle assembly 10 comprising a rifle 12 and a fore grip assembly 14 in accordance with the present invention. The fore grip assembly 14 comprises a fore grip 16 and an accessory 18. The inventive fore grip 14 is operably connected to rifle 12. Generally, the fore grip 14 is connected to a rail of rifle 12 such as a Picatinny rail. The top portion of the fore grip 16 may have any components known in the field (not shown) to engage with the rail of the rifle 12. Fore grip 16 comprises a fore grip body 20, which may secure or release an attachment such as the "brass knuckles" 18, which may or may not be made of brass, and which are also commonly referred to as knuckle guards, knucks, knucklebusters, or knuckledusters, and which will be referred to hereinafter as "knuckle guards." Other attachments may include but are not limited to a bipod, light, red dot laser, knife, night vision device, grenade, or the like. The fore grip 16 is stationary once secured to rifle 12 and is configured to allow a user to quickly and easily interchange accessories.

Figure 2:
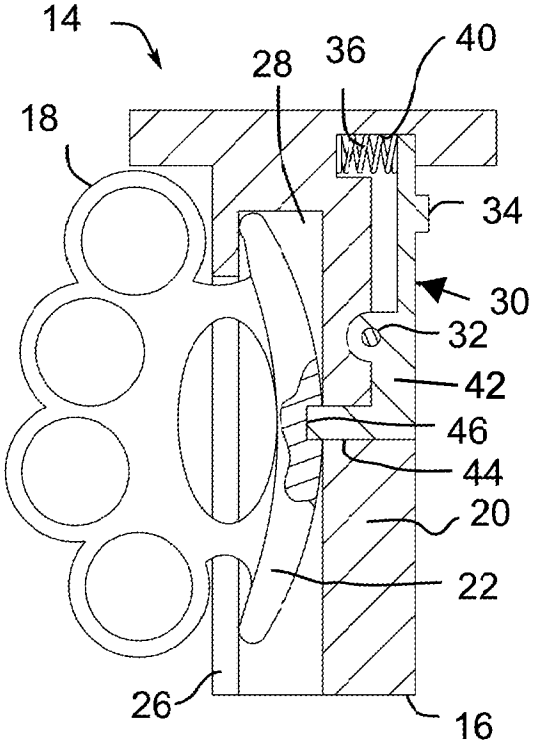
FIG. 2 depicts a cross-sectional view of one embodiment of the rifle fore grip.

FIG. 2 illustrates a first embodiment of the inventive fore grip assembly 14. A knuckle guard 18 is secured to the fore grip 16. The knuckle guard 18 comprises a palm grip 22. The fore grip body 20 comprises a slot 26 that leads to a cavity 28 inside the body. The cavity 28 is sized to receive the palm grip 22 of the accessory 18. A latch 30 is pivotally mounted on a pivot pin 32. The back of the latch may include a button 34 positioned above the pivot 32 and opposite the spring 36, which is received in a spring recess 40 formed in the top portion of the body 20 at the top of the cavity 28. In this embodiment, the latch 30 comprises an L-shaped member 42 having an angled end 44 that engages a groove or notch 46 or other recess in the back of the handle or palm grip 22 on the brass knuckle guard 18. The spring 36 biases the latch 30 in the first locked position. The notch 46 in the back of the palm grip 22 may be formed in any suitable manner. The notch may be formed in the knuckles when originally manufactured or machined into previously made knuckles. Thus, the palm grip 22 of the knuckle guard 18 forms an insert receivable in the cavity 28 for securing the accessory 18 to the fore grip 16.

In operation, a user places the insert of the accessory 18 within the slot 26 and cavity 28 such that the pivotable latch 30 engages with groove 46 to secure accessory in a locked position. To release accessory 18 from fore grip 16, a user pushes the button 34, which compresses the spring 36. As the spring 36 compresses, the latch 30 pivots at the pin 32, which backs the angled end 44 out of the groove 46 in the palm grip 22, releasing the accessory 18. This allows the user to easily remove the accessory 18 from the fore grip 16.

Figure 3:
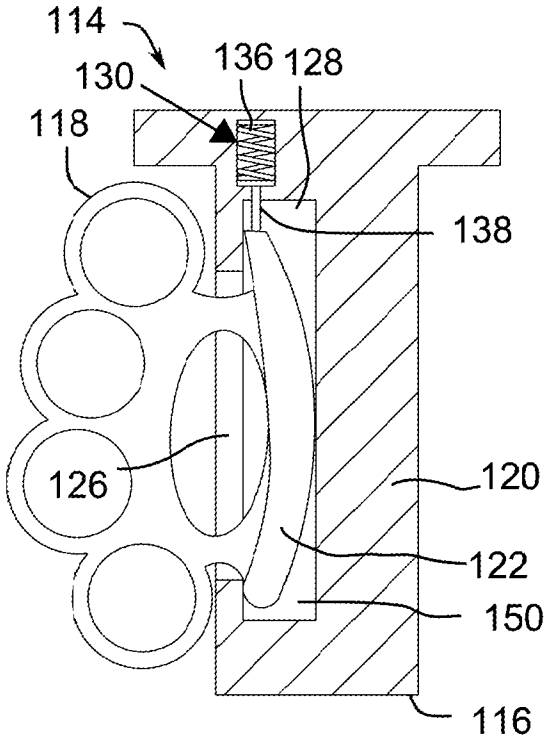
FIG. 3 depicts a cross-sectional view of one embodiment of the rifle fore grip.

As depicted in FIG. 3, an alternative embodiment of fore grip assembly 114 comprises fore grip body 120, slot 126, cavity 128, pin 138, and spring 136, the pin and spring forming a latch 130. The cavity 128 may be closed at the bottom forming a recess 150 for receiving the bottom portion of the palm grip 122. In operation, a user places the accessory 118 within slot 126 and cavity 128 such that the top portion of the palm grip 122 engages the end of the pin 138 slightly compressing the spring 136 and the bottom is received in the recess 150. This allows the user to maneuver accessory 118 in position that secures the accessory within the cavity 128 and against the interior walls of cavity in a locked or engaged position. Once in the engaged position, the spring 136 biases the pin 138 downwardly compressing the palm grip 122 inside the cavity 128. To release accessory 118 from fore grip 116, the user pushes up on palm grip 122 of the accessory to slightly compress the spring 136 and pin 138 thereby permitting removal of the palm grip from the cavity 128.

Figure 4:
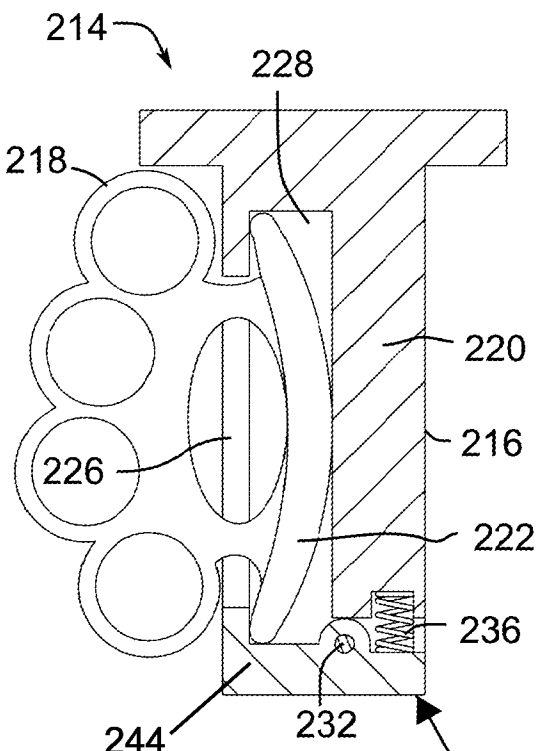
FIG. 4 depicts a cross-sectional view of one embodiment of the rifle fore grip.

As depicted in FIG. 4, an alternative embodiment of fore grip assembly 214 comprises the fore grip body 220, slot 226, cavity 228, pivotable latch 230, pivot pin 232 and spring 236. In operation, a user places the accessory 218 through the slot 226 into the cavity 228 such that angled end 244 of the pivotable latch 230 captures the bottom of the palm grip 222. Pivotable latch 230 is in a locked position when the spring 236 is extended (uncompressed) position. To release the accessory 218 from the fore grip 216, the user pushes down on the palm grip 222 to pivot the latch 230 toward the release or unlocked position. This compresses the spring 236 and lengthens the opening formed by the slot 226 to allow removal of the palm grip 222 from the cavity 228.

It shall be appreciated that the components of the fore grip and accessories described in several embodiments herein may comprise any known materials in the field and be of any color, size and/or dimensions. These materials may include, but are not limited to, steel, stainless steel, aluminum, resins, polymers, carbon fiber, wood, or the like. It shall be appreciated that the components of the fore grip and attachments described herein may be manufactured and assembled using any known techniques in the field such as casting or machining techniques.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A rifle fore grip for use with a rifle to releasably attach an accessory to the rifle, the accessory including an insert, wherein the insert on the accessory is vertically elongated having upper and lower ends, the fore grip comprising:

a body connectable to the rifle, the body having a front facing the same direction as the barrel of the rifle when connected thereto and a back on a side opposite the front, the body defining the grip portion of the fore grip and comprising a cavity inside the grip portion configured to receive the insert on the accessory, wherein the front of the body defines an elongate slot continuous with the cavity, wherein the cavity has a length, wherein the slot has a length that is less than the length of the cavity to form an upper recess in the cavity; and a latch operably connected to the body and movable between a first locked position and a second unlocked position, wherein in the first locked position the latch is engaged with the insert on the accessory when the insert is received in the cavity of the fore grip to prevent removal of the accessory from the fore grip and wherein in the second unlocked position the latch is disengaged from the insert to permit removal of the accessory from the fore grip;

wherein the latch comprises an L-shaped member having a first straight end and a second angled end, wherein the latch further comprises a spring that biases the latch toward the first locked position, and wherein the latch is pivotally mounted to the body at a pivot point between the first and second ends;

wherein the latch is configured so that when the insert is received within the cavity and the latch is in the first locked position, the upper end of the insert is confined in the upper recess of the cavity and the angled end of the L-shaped latch member engages a recess in the insert to prevent the accessory from being removed from the fore grip.

2. The rifle fore grip of claim 1 wherein the slot and the cavity in the body are open at the bottom of the fore grip so that the insert is insertable slidably from the bottom of the fore grip.

3. The rifle fore grip of claim 2 wherein the latch further comprises a button at or near the straight end of the L-shaped member, wherein the button is positioned so that pressure on the button compresses the spring to move the latch from the first locked position to the second unlocked position.

4. The rifle fore grip of claim 3 wherein the fore grip is mountable under the barrel of the rifle generally perpendicular thereto, wherein the slot is positioned on the front of the body, and wherein the button is positioned on the back of the body.

5. A fore grip assembly comprising the accessory and the fore grip as recited in claim 4.

6. The fore grip assembly of claim 5 wherein the accessory is a knuckle guard, a knife, a bipod, a light, or a laser.

7. The fore grip assembly of claim 6 wherein the accessory is a knuckle guard having a palm grip and the palm grip of the knuckle guard comprises the insert.

8. A rifle assembly comprising a rifle and the fore grip assembly of claim 7.

9. A rifle fore grip for use with a rifle to releasably attach an accessory to the rifle, the accessory including an insert, wherein the insert on the accessory is vertically elongated having upper and lower ends, the fore grip comprising:

a body connectable to the rifle, the body defining the grip portion of the fore grip and comprising a cavity inside the grip portion configured to receive the insert on the accessory, the body having a front facing the same direction as the barrel of the rifle when connected thereto and a back on a side opposite the front, wherein the body defines an elongate slot continuous with the cavity, wherein the cavity has a length and the slot has a length that is less than the length of the cavity to form an upper recess and a lower recess; and a latch operably connected to the body and movable between an first locked position and a second unlocked position, wherein in the first locked position the latch is engaged with the insert on the accessory when the insert is received in the cavity of the fore grip to prevent removal of the accessory from the fore grip, and wherein in the second unlocked position the latch is disengaged from the insert to permit removal of the accessory from the fore grip, wherein the latch comprises an L-shaped member having a first straight end and a second angled end, wherein the latch further comprises a spring that biases the latch toward the first locked position, wherein the L-shaped latch member is mounted on the bottom of the body so that the second, angled end is adjacent the bottom of the slot;

wherein the latch and the accessory insert are cooperatively configured so that when the insert is received within the cavity and the latch is in the first locked position, the upper end of the insert is confined in the upper recess and the lower end of the insert is confined by the second, angled end of the L-shaped latch member to prevent the accessory from being removed from the fore grip.

10. The rifle fore grip of claim 9 wherein the fore grip is mountable under the barrel of the rifle generally perpendicular thereto, wherein the slot is positioned on the front of the body, and wherein the spring is positioned above the straight end of the L-shaped latch member so that downward pressure on the angled end moves the latch from the first locked position to the second unlocked position.

11. A fore grip assembly comprising the accessory and the fore grip as recited in claim 10.

12. The fore grip assembly of claim 11 wherein the accessory is a knuckle guard, a knife, a bipod, a light, or a laser.

13. The fore grip assembly of claim 12 wherein the accessory is a knuckle guard having a palm grip and the palm grip of the knuckle guard comprises the insert.

14. A rifle assembly comprising a rifle and the fore grip assembly of claim 13.

15. A rifle fore grip for use with a rifle to releasably attach an accessory to the rifle, the accessory including an insert, wherein the insert on the accessory is vertically elongated having upper and lower ends, the fore grip comprising:

a body connectable to the rifle, the body defining the grip portion of the fore grip and comprising a cavity inside the grip portion configured to receive the insert on the accessory, the body having a front facing the same direction as the barrel of the rifle when connected thereto and a back on a side opposite the front, wherein the body defines an elongate slot continuous with the cavity, wherein the cavity has a length and the slot has a length that is less than the length of the cavity to form an upper recess and a lower recess; and a latch operably connected to the body and movable between a first locked position and a second unlocked position, wherein in the first locked position the latch is engaged with the insert on the accessory when the insert is received in the cavity of the fore grip to prevent removal of the accessory from the fore grip, and wherein in the second unlocked position the latch is disengaged from the insert to permit removal of the accessory from the fore grip, wherein the latch comprises a pin mounted for vertical movement in the top of the body and a spring positioned to bias the pin downwardly;

wherein the cavity in the body and the accessory insert are cooperatively configured so that when the insert is received within the cavity and the latch is in the first locked position, the upper end of the insert is confined in the upper recess, the lower end of the insert is confined by the lower recess, and the lower end of the pin pressingly engages the upper end of the insert to prevent the accessory from being removed from the fore.

16. A fore grip assembly comprising the accessory and the fore grip as recited in claim 15.

17. The fore grip assembly of claim 16 wherein the accessory is a knuckle guard, a knife, a bipod, a light, or a laser.

18. The fore grip assembly of claim 17 wherein the accessory is a knuckle guard.

19. A rifle assembly comprising a rifle and the fore grip assembly of claim 18.

* * * * *

UNITED STATES PATENT AND TRADEMARK OFFICE

CERTIFICATE OF CORRECTION

PATENT NO. : 9,228,798 B1
APPLICATION NO. : 14/547593
DATED : January 5, 2016
INVENTOR(S) : Alex Austin Viola It is certified that error appears in the above-identified patent and that said Letters Patent is hereby corrected as shown below:

In the Claims:

Column 4, line 36, Claim 9: replace “between an first” with --between a first--.
Column 6, line 15, Claim 15: replace “fore.” with --fore grip.--.

Signed and Sealed this
Nineteenth Day of April, 2016

Michelle K. Lee

Michelle K. Lee
*Director of the United States Patent and Trademark Office*